US012655628B2

(12) United States Patent
Haba et al.

(10) Patent No.: US 12,655,628 B2
(45) Date of Patent: Jun. 16, 2026

(54) ASSEMBLY FOR ACOUSTICAL MITIGATION IN A BUILDING

(71) Applicant: Telling Industries, LLC, Willoughby, OH (US)

(72) Inventors: Charles A. Haba, Kirtland, OH (US); Thomas D. Ogle, York, SC (US)

(73) Assignee: Telling Industries, LLC, Willoughby, OH (US)

( * ) Notice: Subject to any disclaimer, the term of this patent is extended or adjusted under 35 U.S.C. 154(b) by 271 days.

(21) Appl. No.: 18/390,426

(22) Filed: Dec. 20, 2023

(65) Prior Publication Data

US 2024/0200325 A1 Jun. 20, 2024

Related U.S. Application Data

(60) Provisional application No. 63/476,181, filed on Dec. 20, 2022.

(51) Int. Cl.
*E04B 1/82* (2006.01)

(52) U.S. Cl.
CPC ..... *E04B 1/82* (2013.01)

(58) Field of Classification Search
CPC .. E04B 1/82; E04B 1/8209; E04B 2001/8263; E04B 2001/8272; E04B 2001/8281; E04B 2001/829
See application file for complete search history.

(56) References Cited

U.S. PATENT DOCUMENTS

| | | | | |
|---|---|---|---|---|
| 3,460,307 | A * | 8/1969 | Faerber | E04B 1/24 52/106 |
| 6,125,608 | A * | 10/2000 | Charlson | F16B 33/02 52/847 |
| 7,647,744 | B2 | 1/2010 | Payne, Jr. | |
| 12,173,769 | B1 * | 12/2024 | Saathoff | E04B 1/82 |
| 2006/0042874 | A1 * | 3/2006 | Foster | E04B 2/7411 181/290 |
| 2007/0294972 | A1 * | 12/2007 | Ducharme | G10K 11/16 52/351 |
| 2008/0008345 | A1 | 1/2008 | Donaldson | |
| 2008/0017780 | A1 * | 1/2008 | Downey | F16F 1/373 248/610 |
| 2008/0086966 | A1 * | 4/2008 | Stevens | F16F 1/3732 52/347 |
| 2008/0092458 | A1 * | 4/2008 | Payne | E04B 1/82 52/144 |

(Continued)

FOREIGN PATENT DOCUMENTS

WO WO-2022108511 A1 * 5/2022 ..... E04B 1/82

*Primary Examiner* — Kyle J. Walraed-Sullivan
(74) *Attorney, Agent, or Firm* — Sisson & Banyas, Attorneys at Law, LLC; Edwin A. Sisson

(57) ABSTRACT

An assembly for acoustical mitigation in a building may comprise a stud and at least one first acoustical isolator. The stud may comprise a web, and a first flange. The first flange extending substantially perpendicular to the web and having at least one first flange acoustical isolator through-hole or partially lanced-hole. At least a portion of the first acoustical isolator may pass through the first flange acoustical isolator through-hole or partially lanced-hole. The first acoustical isolator may be configured to acoustically isolate the stud and a first wall panel supported by the stud.

2 Claims, 8 Drawing Sheets

(56) References Cited

U.S. PATENT DOCUMENTS

| | | | | |
|---|---|---|---|---|
| 2009/0173029 | A1* | 7/2009 | Socha | E04B 1/82 24/485 |
| 2010/0251652 | A1* | 10/2010 | Golden | E04B 9/18 29/897.3 |
| 2010/0263321 | A1* | 10/2010 | Stevens | F16F 1/3732 52/741.1 |
| 2011/0140325 | A1* | 6/2011 | Downey | E04B 1/98 267/141.1 |
| 2015/0369323 | A1* | 12/2015 | Downey | F16F 1/376 248/634 |
| 2018/0111361 | A1* | 4/2018 | Ober | E04B 1/84 |
| 2018/0180127 | A1* | 6/2018 | Downey | F16F 1/373 |
| 2019/0195303 | A1* | 6/2019 | Stevens | E04B 1/82 |
| 2021/0071414 | A1* | 3/2021 | Lee | E04C 2/02 |
| 2021/0295813 | A1* | 9/2021 | Gernhart | G10K 11/16 |
| 2021/0341029 | A1* | 11/2021 | Downey | E04F 13/0805 |
| 2022/0136235 | A1* | 5/2022 | Valerio | F16F 1/025 181/175 |
| 2022/0364373 | A1* | 11/2022 | Downey | E04F 15/225 |
| 2023/0383809 | A1* | 11/2023 | Downey | F16F 15/00 |
| 2024/0011515 | A1* | 1/2024 | Issal | F16B 5/0283 |

* cited by examiner

ASSEMBLY FOR ACOUSTICAL MITIGATION IN A BUILDING

CROSS REFERENCES AND PRIORITIES

This application claims priority from U.S. Provisional Application No. 63/476,181 filed on 20 Dec. 2022, the teachings of which are incorporated by reference herein in their entirety.

BACKGROUND

Many buildings encounter problems isolating acoustics between rooms. This is particularly true in multi-tenant buildings such as offices, apartment buildings, schools, and condominiums. In such buildings, it is often important to isolate sounds to one room so that occupants of another room cannot hear them. This is difficult for many structures, particularly those having walls comprising steel studs. The steel studs can often act as a type of tuning fork which enhances the sound transmission from one room to another.

The ability of a wall to attenuate airborne sound is commonly rated in a Sound Transmission Class (STC). The STC for a particular wall may be measured using ASTM International Classification E90 (last updated Jan. 19, 2017).

Many solutions have been proposed to address the problem of sound transmission through walls in steel studded buildings. One solution is to increase the number of layers of wall material (drywall, gypsum, or the like) attached to the steel studs. Laboratory testing has shown that, by adding a second layer of wall material, the additional wall material will absorb more of the sound waves before they can reach the metal stud. However, multiple layers of wall material increase the expense of the wall by requiring more materials and increased labor time. Multiple layers of wall material also result in a much heavier wall requiring additional structural support. In addition, the resulting wall often fails to achieve a desired level of sound transmission.

Other solutions seek to decouple the wall material (drywall, gypsum, or the like) from the steel studs. This is commonly done using what is known as a resilient channel. A resilient channel is a longitudinal piece of material—typically roll formed—that typically runs perpendicular across the steel studs. The material typically includes at least three integral members—a first member for attaching to the studs, a second member for attaching to the wall material, and a third member between the first and second members for separating the stud from the wall. This third member may have a plurality of through-holes or slots. Some resilient channels have a fourth member and a fifth member with the fifth member also attaching to the stud, and the fourth member located between the third member and the fifth member for separating the stud from the wall. This fourth member may also have a plurality of through-holes. Laboratory testing has shown that this holed second (and an optionally fourth) member absorbs a portion of the sound waves before they can reach the metal stud.

It has been found that the resilient channel can block approximately the same amount of sound as two layers of wall material. Accordingly, using only a resilient channel may still be insufficient to achieve a desired level of sound transmission.

One alternative solution is to utilize a series of clips to attach the resilient channel to the steel studs. One such clip is disclosed in U.S. Pat. No. 9,388,572. It is believed that the clips further decouple the wall material from the steel stud, leading to an improved STC rating. However, the clips add an additional part to the wall installation, making the installer's job more difficult as they have to align the clips and the resilient channel before fastening both to the stud.

Additional prior art solutions include adhesives that are applied in the field (i.e. field applied) to the wall studs. One example is a brand called "Green Glue®" available from Saint-Gobain Performance Plastics Corporation of Solon, Ohio, U.S.A. However, these adhesives must be applied in the field, and require one to wait multiple days for the field applied adhesive to cure before hanging wall board.

The need exists, therefore, for an improved apparatus for attenuate airborne sound in a wall which requires no additional parts during field installation and does not require a wait time for curing in the field.

SUMMARY

It is described herein an assembly for acoustical mitigation in a building. The assembly comprises a stud and at least one first acoustical isolator. The stud having a web and a first flange with the first flange extending substantially perpendicular to the web and having at least one first flange acoustical isolator through-hole or partially lanced-hole passing through the first flange from a first flange web side to a first flange side opposite the web. At least a portion of the first acoustical isolator passes through the first flange acoustical isolator through-hole or partially lanced-hole. The first acoustical isolator is configured to acoustically isolate the stud and a first wall panel supported by the stud.

In some embodiments, the at least one first acoustical isolator may comprise a first body, at least one first standoff peg extending from a bottom surface of the first body, a first stem approximately centrally located and extending from the bottom surface of the first body, and a first lock attached to the first stem. The first lock and a portion of the first stem may pass through the first flange acoustical isolator through-hole or partially lanced-hole so that the first lock is on the first flange web side and the first body is on the first flange side opposite the web.

In certain embodiments, the at least one first flange acoustical isolator through-hole or partially lanced-hole may comprise a plurality of first flange acoustical isolator through-holes or partially lanced-holes. The at least one first acoustical isolator may then comprise a plurality of acoustical isolators, and at least a portion of each first acoustical isolator of the plurality of first acoustical isolators may pass through a corresponding first flange acoustical isolator through-hole or partially lanced-hole of the plurality of first flange acoustical isolator through-holes or partially lanced-holes. The plurality of first flange acoustical isolator through holes may be spaced approximately twenty-four inches apart, sixteen inches apart, or twelve inches apart from one another along a length of the first flange.

In some embodiments, the at least one first flange acoustical isolator through-hole or partially lanced-hole may have a shape selected from the group consisting of substantially circular, substantially triangular, substantially quadrilateral, and substantially rectangular. In certain embodiments, the at least one first flange acoustical isolator through-hole or partially lanced-hole may comprise a first portion and a second portion with the first portion having a larger dimension than the second portion, and the first acoustical isolator configured to slideably engage with the first acoustical isolator through hole.

In certain embodiments, the stud may further comprise a first lip extending substantially perpendicular from the first flange. The first lip may be substantially parallel with the web.

In some embodiments, the stud may further comprise a second flange while the assembly may further comprise at least one second acoustical isolator. The second flange, when present, may extend substantially perpendicular to the web in the same direction as the first flange and may have at least one second flange acoustical isolator through-hole or partially lanced-hole passing through the second flange from the second flange web side to a second flange side opposite the web. The second acoustical isolator, when present, may pass through the second flange acoustical isolator through-hole or partially lanced-hole and may be configured to acoustically isolate the stud and a second wall panel supported by the stud.

In certain embodiments, the at least one second acoustical isolator may comprise a second body, at least one second standoff peg extending from a bottom surface of the second body, a second stem approximately centrally located and extending from the bottom surface of the second body, and a second lock attached to the second stem. The second lock and a portion of the second stem may pass through the second flange acoustical isolator through-hole or partially lanced-hole so that the second lock is on the second flange web side and the second body is on the second flange side opposite the web.

In some embodiments, the at least one second flange acoustical isolator through-hole or partially lanced-hole may comprise a plurality of second flange acoustical isolator through-holes or partially lanced-holes. The at least one second acoustical isolator may then comprise a plurality of second acoustical isolators, and at least a portion of each second acoustical isolator of the plurality of second acoustical isolators may pass through a corresponding second flange acoustical isolator through-hole or partially lanced-hole of the plurality of second flange acoustical isolator through-holes or partially lanced-holes. The plurality of second flange acoustical isolator through-holes or partially lanced-holes may be spaced approximately twenty-four inches apart, sixteen inches apart, or twelve inches apart from one another along a length of the first flange.

In certain embodiments, the at least one second flange acoustical isolator through-hole or partially lanced-hole may have a shape selected from the group consisting of substantially circular, substantially triangular, substantially quadrilateral, and substantially rectangular. In some embodiments, the at least one second flange acoustical isolator through-hole or partially lanced-hole may comprise a first portion and a second portion with the first portion having a larger dimension than the second portion, and the second acoustical isolator may be configured to slideably engage with the first acoustical isolator through hole.

In some embodiments, the stud may further comprise a second lip extending substantially perpendicular from the second flange. The second lip may be substantially parallel with the web.

In certain embodiments, the first acoustical isolator may be inserted into the at least one first flange acoustical isolator through-hole or partially lanced-hole while the stud is being manufactured in a continuous manner. A first speed of manufacturing the stud with the first acoustical isolator may be not less than a second speed of manufacturing the stud without the first acoustical isolator.

In some embodiments, the first acoustical isolator may be inserted into the at least one first flange acoustical isolator through-hole or partially lanced-hole while the stud is being manufactured in a continuous manner with the second acoustical isolator being inserted into the at least one second flange acoustical isolator through-hole or partially lanced-hole while the stud is being manufactured in the continuous manner. A first speed of manufacturing the stud with the first acoustical isolator and the second acoustical isolator may be not less than a second speed of manufacturing the stud without the first acoustical isolator and the second acoustical isolator.

DETAILED DESCRIPTION

Disclosed herein are various embodiments of an assembly for acoustical mitigation in a building and methods of making such an assembly. The assembly is described below with reference to the Figures. As described herein and in the claims, the following numbers refer to the following structures as noted in the Figures.

5 refers to a prior art clip.
10 refers to an assembly.
12 refers to a prior art wallboard support channel.
18 refers to a prior art free edge.
20 refers to a prior art flat web.
22 refers to a prior art wallboard panel.
24 refers to a prior art inclined panel.
26 refers to a prior art inclined panel.
28 refers to a prior art support channel mounting point.
30 refers to a prior art fastener.
32 refers to a prior art frame member.
34 refers to a prior art first portion of a resilient acoustically dampening bushing or grommet.
36 refers to a prior art second portion of a resilient acoustically dampening bushing or grommet.
38 refers to a prior art upper surface.
40 refers to a prior art lower surface.
42 refers to a prior art U-shaped bracket.
44 refers to a prior art first annular formation.
46 refers to a prior art exterior surface of U-shaped bracket.
48 refers to a prior art second annular formation.

50 refers to a prior art interior surface of a U-shaped bracket.
52 refers to a prior art fastener opening.
56 refers to a prior art aperture.
58 refers to a prior art leg.
64 refers to a prior art head of a fastener.
66 refers to a prior art wallboard fastener.
100 refers to a stud.
110 refers to a web.
120 refers to a first flange.
122 refers to a first lip.
124 refers to a first flange acoustical isolator through-hole.
130 refers to a second flange.
132 refers to a second lip.
134 refers to a second flange acoustical isolator through-hole.
210 refers to a first acoustical isolator.
212 refers to a first body.
214 refers to a first standoff peg.
216 refers to a first stem.
218 refers to a first lock.
220 refers to a second acoustical isolator.
222 refers to a second body.
224 refers to a second standoff peg.
226 refers to a second stem.
228 refers to a second lock.
300 refers to a first wall panel.
310 refers to a first fastener.
320 refers to a second wall panel.
325 refers to a second fastener.
330 refers to a track.
400 refers to a prior art metal channel.
425 refers to a prior art sound suppression material.
430 refers to a prior art sound suppression material.
500 refers to a prior art polymer layer.
510 refers to a prior art adhesive layer.
520 refers to a prior art abrasion resistance layer.

Figure 1:
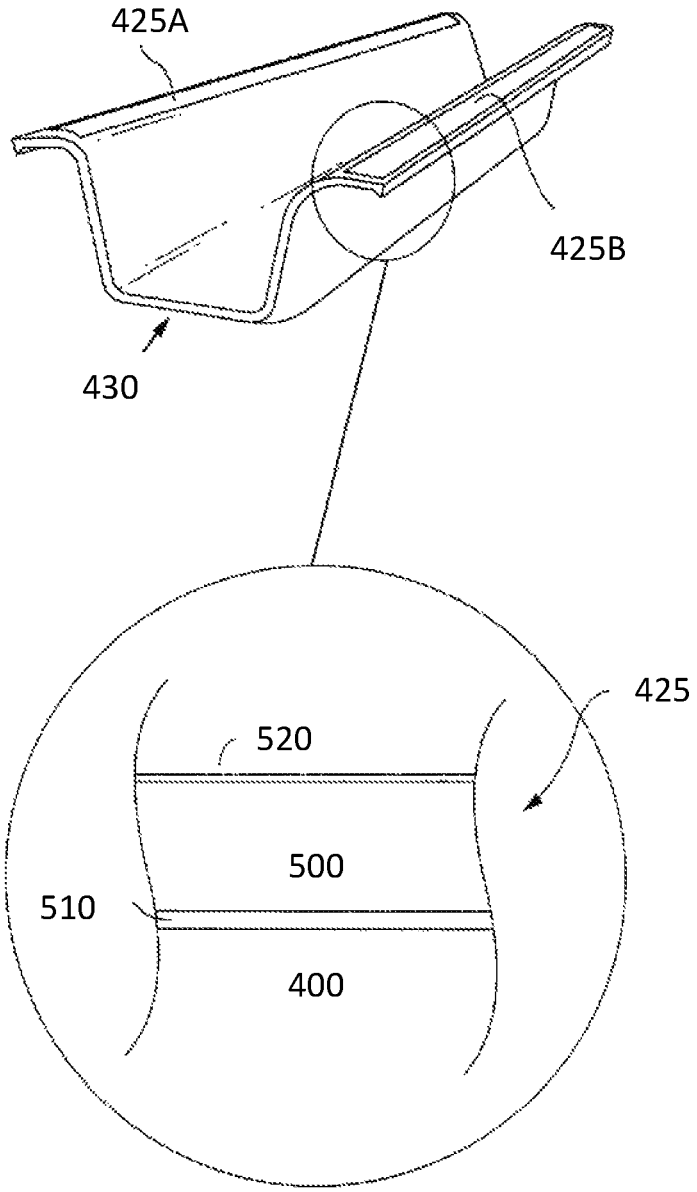
FIG. 1 (Prior Art)
FIG. 1 is a view of one prior art apparatus for attenuating airborne sound in a wall.
Figure 2:
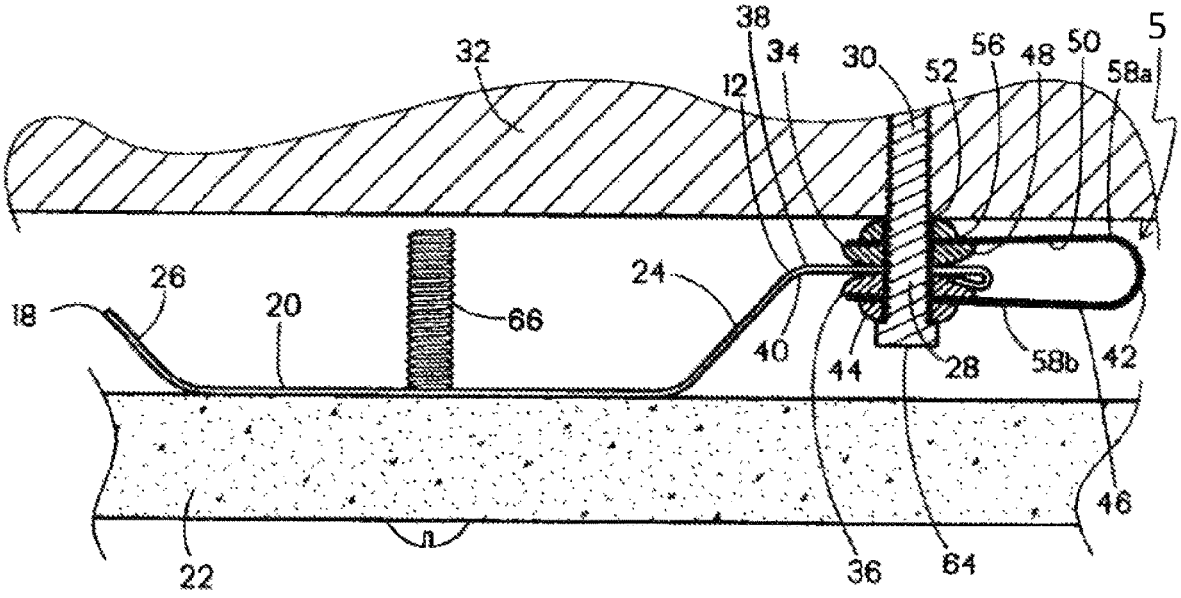
FIG. 2 (Prior Art)
FIG. 2 is a view of another prior art apparatus for attenuating airborne sound in a wall.

FIG. 1 and FIG. 2 depict prior art apparatus for attenuating airborne sound in a wall. FIG. 1 is FIG. 3 from United States Patent Publication 2008/0008345 to Donaldson, the teachings of which are incorporated by reference herein in their entirety. According to Donaldson, the sound suppression material (425) illustrated is constructed of layers, namely a polymer layer (500) for the absorption of sounds/vibrations, an adhesive layer (510) to attach the polymer layer (500) to the metal channel (400), and an abrasion resistance layer (520) (e.g. hard plastic layers such as [Phenolic] hard plastic) that also helps absorb sound and functions as abrasion resistance used to protect the polymer layer (500) from being damaged. The sound suppression material (430) is similarly constructed to material (425), but is, for example, wider (to better fit the wider top area of the hat channel. Note: The numbering from FIG. 3 in Donaldson has been changed to avoid conflicts with the invention of this specification.

FIG. 2 is FIG. 4 from U.S. Pat. No. 7,647,744 to Payne, the teachings of which are incorporated by reference herein in their entirety. According to Payne, sound suppression is accomplished by a clip (5) for use in acoustically isolating a wallboard support channel (12) from a frame member (32), the support channel having at least one mounting point (28), includes a first portion positionable between a first surface of the channel and the frame member, a second portion positionable in contact with a second, opposite surface of the channel, and a bracket connecting said first and second portions. The first and second portions and the bracket each have at least one fastener opening in registry with corresponding openings on the other of the first and second portions such that a fastener (30) passing through the openings and the mounting point is acoustically isolated from the bracket and from the channel. Note: The numbering of element 10 from FIG. 4 in Payne has been changed to 5 to avoid conflicts with the invention of this specification.

Figure 3:
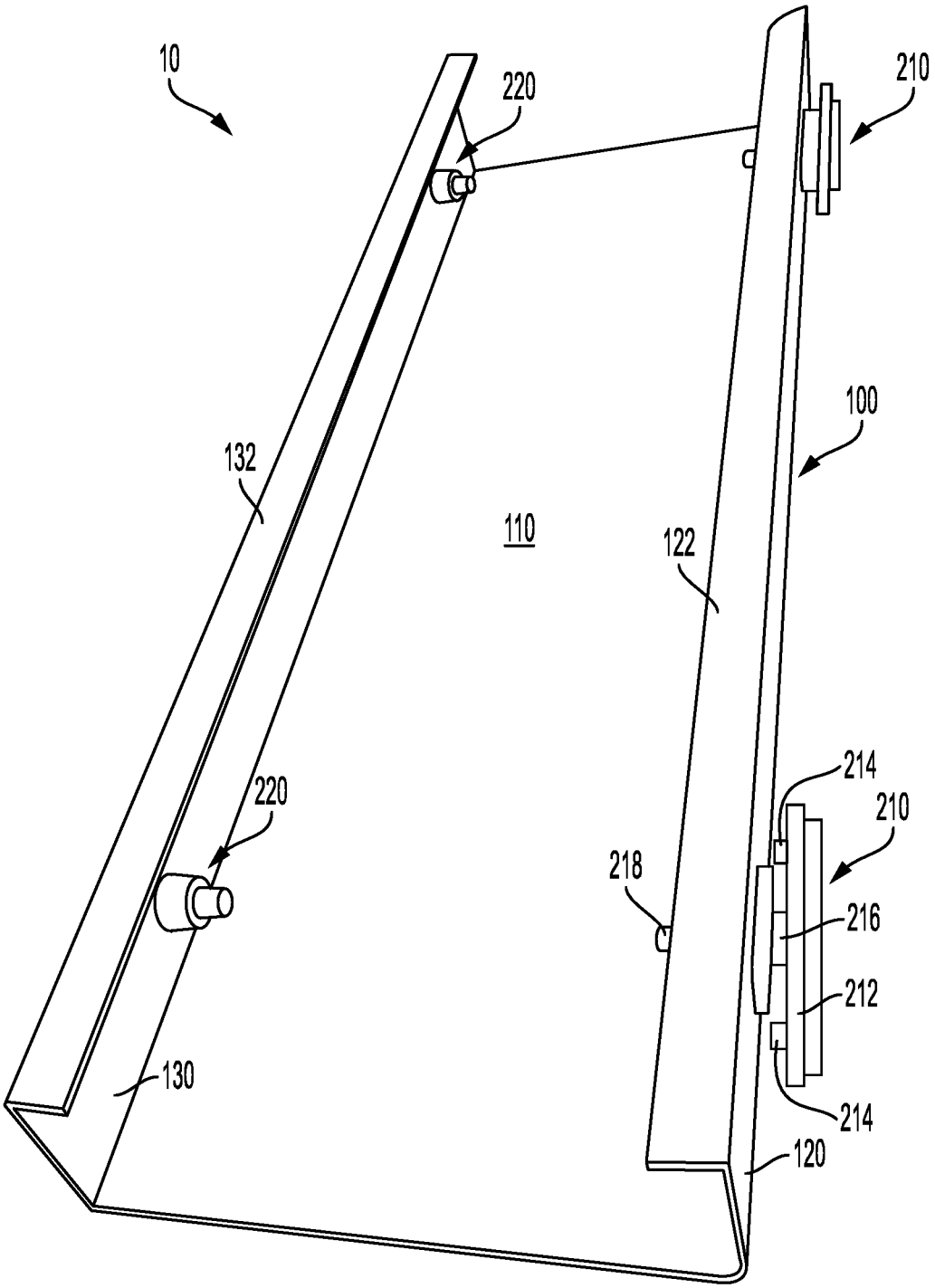
FIG. 3 is a perspective view of a stud with a plurality of acoustical isolators attached thereto.
Figure 4A:
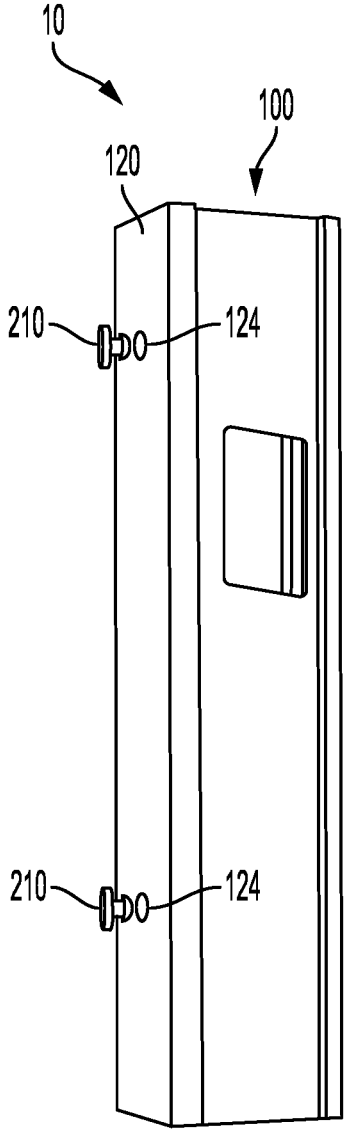
FIG. 4A is an exploded bottom view of a stud having a plurality of acoustical isolators.
Figure 4B:
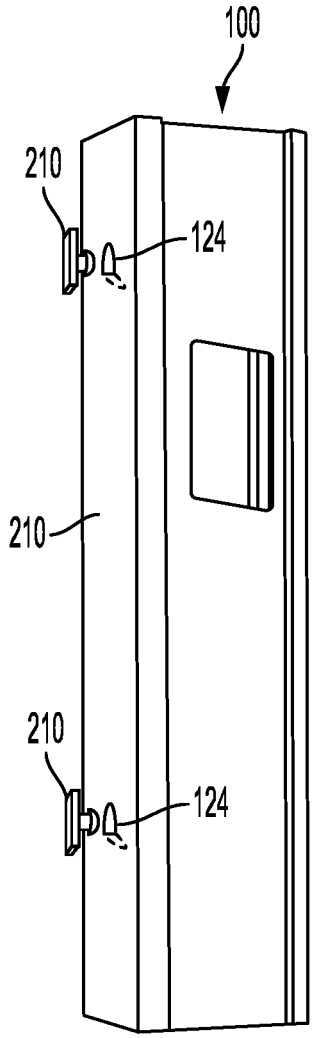
FIG. 4B is an exploded bottom view of an alternative embodiment of a stud having a plurality of acoustical isolators.

FIG. 3 depicts an embodiment of an assembly (10) for acoustical mitigation in a building. As shown in FIG. 3, the assembly comprises a stud (100) and at least one first acoustical isolator (210). The stud will have at least a web (110) and a first flange (120) extending substantially perpendicular or perpendicular to the web. Said first flange will have at least one first flange acoustical isolator through-hole (124 as shown in FIG. 4A and FIG. 4B) or partially lanced-hole passing from an outer surface of the first flange through an inner surface of the first flange. In certain embodiments, the stud may also comprise a first lip (122). When present, the first lip extends substantially perpendicular from or perpendicular from the first flange and is substantially parallel with or parallel with the web.

Figure 7:
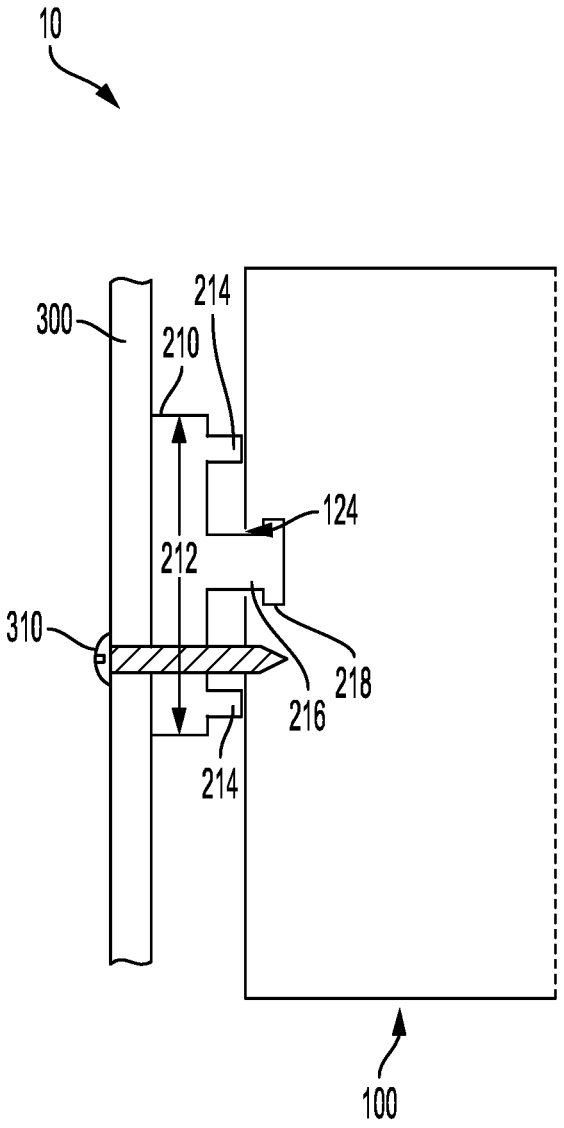
FIG. 7 is a cut-away view showing a wall panel attached to an acoustical isolator which is attached to a stud.
Figure 8:
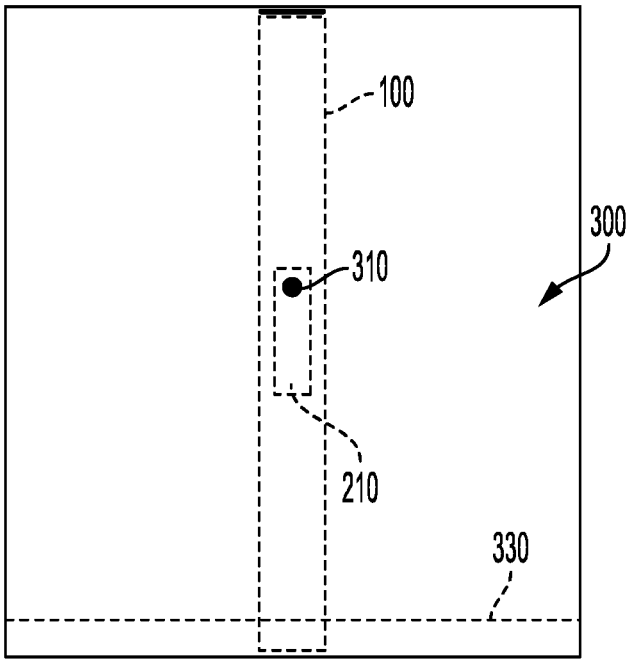
FIG. 8 is a front view of a wall panel attached to an acoustical isolator which is attached to a stud.

At least a portion of the first acoustical isolator (210) passes through the first flange acoustical isolator through-hole (124) or partially lanced-hole as shown in FIG. 4A. The first acoustical isolator is thereby configured to acoustically isolate the stud and a first wall panel (300 as shown in FIG. 7 and FIG. 8) supported by the stud. The first wall panel may be made of any type of material commonly used for forming a wall. Typical non-limiting examples of such include gypsum board, cement board, wood panels, metal panels, and the like.

As shown in FIG. 3, each first acoustical isolator (210) will comprise a first body (212). Extending from a bottom surface of the first body may be one or more first standoff pegs (214). Also extending from the bottom surface of the first body at approximately a central location between a first end and a second end of the first body is a first stem (216). Attached to the first stem is a first lock (218). Preferably, the first lock and at least a portion of the first stem will pass through the first flange acoustical isolator through-hole (124 as shown in FIG. 4A and FIG. 4B) or partially lanced-hole such that the first lock is adjacent to the inner surface of the first flange while the first body is adjacent to the outer surface of the first flange.

As used in this specification, the first acoustical isolators (210) are those acoustical isolators attached to the first flange (120) and the second acoustical isolators (220) are those acoustical isolators attached to the second flange (130). There may be many first acoustical isolators attached to the first flange, and likewise there may be many second acoustical isolators attached to the second flange. In any event the assembly will have at least on first acoustical isolator on the first flange. While the embodiments in the Figures show only one lock per acoustical isolator it is conceived that any one individual acoustical isolator could have multiple stems and multiple locks.

Figure 9:
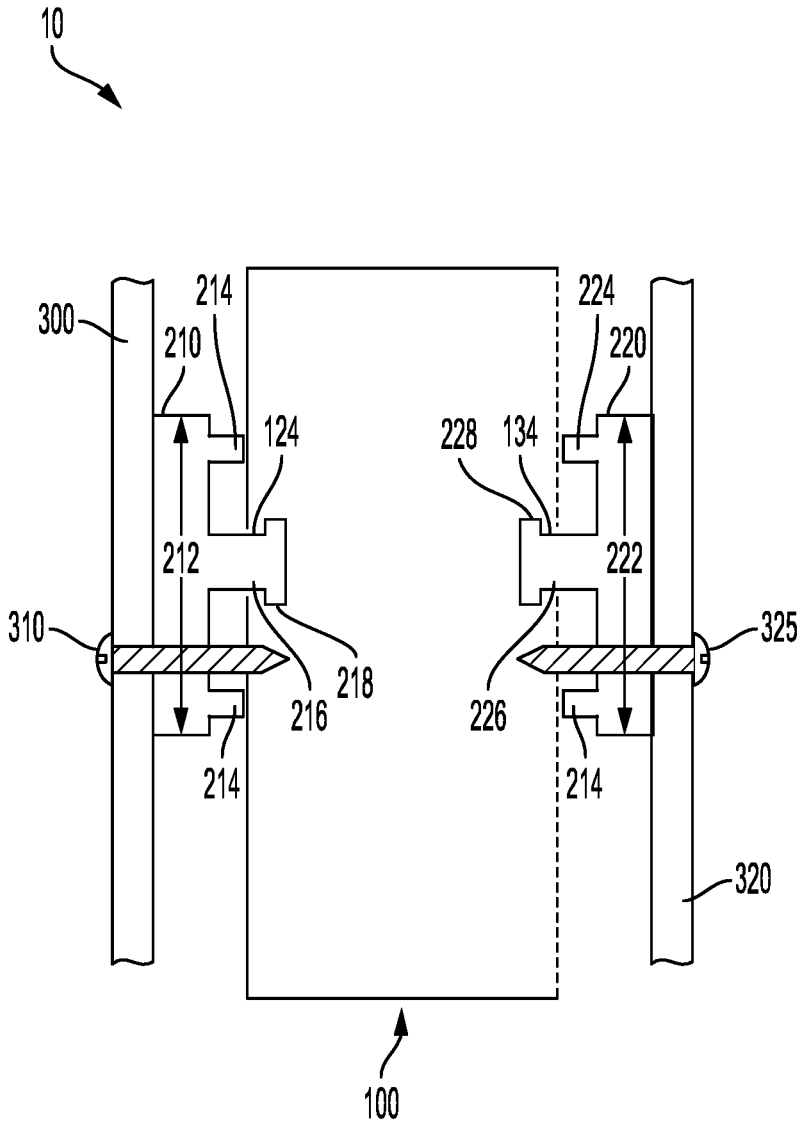
FIG. 9 is a cut-away view showing two wall panels attached to acoustical isolators attached to opposite sides of a stud.

The stud (100) may comprise a second flange (130). When present, the second flange will extend substantially perpendicular to or perpendicular to the web in the same direction as the first flange (120) as shown in FIG. 3. Some embodiments of the assembly may include at least one second flange acoustical isolator through-hole (134 as shown in FIG. 9) or partially lanced-hole. The assembly may then further comprise at least one second acoustical isolator (220) as shown in FIG. 3. In certain embodiments, the stud may also comprise a second lip (132). When present, the second lip extends substantially perpendicular from or perpendicular from the second flange and is substantially parallel with or parallel with the web.

At least a portion of the second acoustical isolator (220)—when present—passes through the second flange acoustical isolator through-hole (134) as shown in FIG. 3. The second acoustical isolator is thereby configured to acoustically isolate the stud and a second wall panel (320 as shown in FIG. 9) supported by the stud. The second wall panel may be made of any type of material commonly used for forming a wall. Typical non-limiting examples of such include gypsum board, cement board, wood panels, metal panels, and the like.

The second acoustical isolator(s) (220)—when present—will be of substantially similar or identical construction to the first acoustical isolator(s). As shown in FIG. 9, each second acoustical isolator will comprise a second body (222). Extending from a bottom surface of the second body may be one or more second standoff pegs (224). Also extending from the bottom surface of the second body at approximately a central location between a first end and a second end of the second body is a second stem (226). Attached to the second stem is a second lock (228). Preferably, the second lock and at least a portion of the second stem will pass through the second flange acoustical isolator through-hole (134) or partially lanced-hole such that the second lock is adjacent to the inner surface of the second flange while the second body is adjacent to the outer surface of the second flange.

In some embodiments, the stud (100) may comprise more than one first flange acoustical isolator through-hole (124) or partially lanced-hole, and/or more than one second flange acoustical isolator through-hole (134) or partially lanced-hole. In such embodiments the acoustical isolator through-hole(s) or partially lanced-hole(s) will be spaced along a length of the respective first flange (120) or second flange (130). Preferably, the first flange acoustical isolator through-holes or partially lanced-holes will be spaced approximately twenty-four inches apart from one another along the length of the first flange. The first flange acoustical isolator through-holes or partially lanced-holes may be spaced approximately sixteen inches apart from one another along the length of the first flange, or approximately twelve inches apart from one another along the length of the first flange in certain embodiments. Similarly, it is preferred that the second flange acoustical isolator through-holes or partially lanced-holes are spaced approximately twenty-four inches apart from one another along the length of the second flange. The second flange acoustical isolator through-holes or partially lanced-holes may be spaced approximately sixteen inches apart from one another along the length of the second flange, or approximately twelve inches apart from one another along the length of the second flange in certain embodiments.

In a preferred embodiment, a bottom first flange acoustical isolator through-hole or partially lanced-hole is spaced approximately two inches upward from a track (330 as shown in FIG. 8) that is installed at the bottom end of the stud (100), a top first flange acoustical isolator through-hole or partially lanced-hole is spaced approximately six inches downward from a track that is installed at the top end of the stud, and intermediate first flange acoustical isolator through-holes or partially lanced-holes are spaced approximately every twenty-four inches apart from one another along the length of the first flange between the bottom first flange acoustical isolator through hole and the top first flange acoustical isolator through-hole or partially lanced-hole. Similarly, a bottom second flange acoustical isolator through-hole or partially lanced-hole may be spaced approximately two inches upward from a track that is installed at the bottom end of the stud, a top second flange acoustical isolator through-hole or partially lanced-hole may be spaced approximately six inches downward from a track that is installed at the top end of the stud, and intermediate second flange acoustical isolator through-holes or partially lanced-holes may be spaced approximately every twenty-four inches apart from one another along the length of the second flange between the bottom second flange acoustical isolator through hole and the top second flange acoustical isolator through-hole or partially lanced-hole.

FIG. 4A and FIG. 4B show different types and shapes of acoustical isolators which may be either the first or the second acoustical isolator. The first acoustical isolator of FIG. 4A shows a rounded acoustical isolator body while the acoustical isolator body of FIG. 4B shows a rectangular body. There is also difference in through-hole or partially lanced-hole shapes between FIGS. 4A and 4B with more possibilities shown in FIG. 6.

Figure 5:
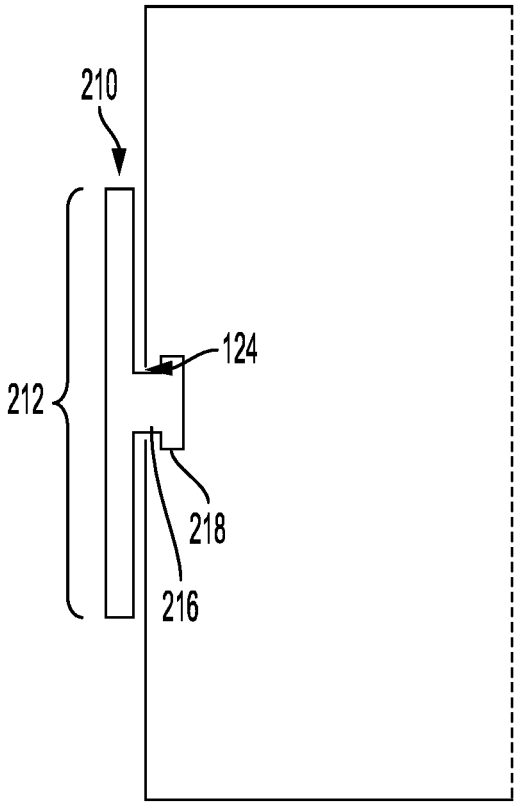
FIG. 5 is a cut-away side view showing an acoustical isolator attached to a stud.

FIG. 5 shows a cut-away view of a cross-section of one embodiment of the assembly (10). In FIG. 5, details of an acoustical isolator and how it interacts with a flange acoustical isolator through-hole or partially lanced-hole are shown. While FIG. 5 is labelled as the first acoustical isolator (210), one of ordinary skill will recognize that FIG. 5 may also be considered as showing the second acoustical isolator (220) which is of substantially similar or identical construction to the first acoustical isolator.

Figure 6:
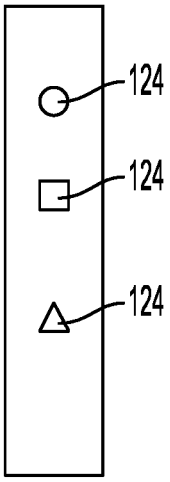
FIG. 6 is a bottom view of a stud showing various embodiments of a flange acoustical isolator through-hole.

FIG. 6 shows various embodiments of a flange acoustical isolator through-hole or partially lanced-hole (which may be either a first flange acoustical isolator through-hole (124) or partially lanced-hole, or a second flange acoustical isolator through-hole (134) or partially lanced-hole). A partially lanced-hole referring to an area in which the material of the stud is stamped through on one less than all sides of the acoustical isolator through-hole shape. That is to say, when the acoustical isolator through-hole shape is to have four sides (i.e.—a square, rectangle, quadrilateral, or the like), the partially lanced-hole stamps through three of the four sides. As shown in FIG. 6, the flange acoustical isolator through-hole or partially lanced-hole may come in a variety of shapes including circular, triangular, quadrilateral, and substantially rectangular. That is to say that the at least one first flange acoustical isolator through-hole or partially lanced-hole has a shape selected from the group consisting of substantially circular, substantially triangular, substantially quadrilateral, and substantially rectangular. Similarly, the at least one second flange acoustical isolator through-hole or partially lanced-hole has a shape selected from the group consisting of substantially circular, substantially triangular, substantially quadrilateral, and substantially rectangular. This acoustical isolator through-hole or partially lanced-hole will have a circumscribed circle in a plane parallel to the plane, or coincident with the plane (i.e. in the plane), of the flange through which the through-hole passes. If the acoustical isolator through-hole or partially lanced-hole is in the shape of a circle, then the circumscribed circle and the circle are the same size and shape making the terms interchangeable when applied to the acoustical isolator lock or the through-hole.

The relationship between the acoustical isolator lock and the acoustical isolator through-hole or partially lanced-hole can be described by the area of the circumscribed circle of the acoustical isolator through-hole and the area of the largest circumscribed circle of the acoustical isolator lock in a plane parallel to the flange. In other words, the diameter of the circumscribed circle of the acoustical isolator through-hole or partially lanced-hole (i.e.—the first acoustical isolator through-hole or partially lanced-hole, or the second acoustical isolator through-hole or partially lanced-hole) is parallel to the diameter of the largest circumscribed circle of the acoustical isolator lock (i.e.—the first lock or the second lock).

The purpose of the acoustical isolator lock is to keep the acoustical isolator body in place and attached to the flange. The acoustical isolator lock does this by having the area of its largest circumscribed circle be greater than the area of the circumscribed circle of the through-hole or partially lanced-hole. In this manner the lock cannot pass through the through-hole or partially lanced-hole without the application of a force.

The acoustical isolator is attached to the flange by the acoustical isolator lock which has been pushed through the through-hole or partially lanced-hole with a force. To accomplish this, the acoustical isolator lock is deformable so that when a force is applied to the acoustical isolator lock parallel to the flange, the area of its largest circumscribed circle can shrink (deform) to less than the area of the circumscribed circle of the through-hole or partially lanced-hole and pass through the through hole. When the force is released, the acoustical isolator lock relaxes/expands so that the area of the largest circumscribed circle of the acoustical isolator lock without the applied force is greater than the area of the circumscribed circle of the through-hole or partially lanced-hole.

The designs of such locking mechanisms are well known in the art. One way is to design the lock to that its features physically deform. An example of this are barbs which depress when passing through the through-hole or partially lanced-hole and expand when on the web side of the flange. Another is to make the lock with at least one very thin ring which deforms as it is pushed through the through-hole or partially lanced-hole and then straightens back when the force is removed. Another mechanism is to make the entire acoustical isolator out of an inherently elastic deformable material such as a rubber, an elastomer, or a thermoplastic elastomer. The materials may inherently thin as the pressure of the through-hole or partially lanced-hole is applied and then recover to their original profile once the pressure of the through-hole or partially lanced-hole is removed after passing through the through-hole or partially lanced-hole. Additionally, the lock mechanism of the lock could include both inherent elastic features of the material of construction and the physical features, like barbs.

While deforming a portion of the acoustical isolator as it is pushed through the acoustical isolator is one method for installing the acoustical isolator, other methods may exist. One such method is to slideably engage the acoustical isolator lock into the acoustical isolator through-hole. In this embodiment, the stem has a head wherein the circumscribed perimeter of the head is larger than the circumscribed perimeter of the stem. In such an embodiment the acoustical isolator through-hole will comprise a first portion and a second portion with the first portion located closer to the upper end of the stud. The first portion will have a larger dimension/diameter than the second portion such that the head of the acoustical isolator lock may pass through the first portion without necessarily requiring deformation of the acoustical isolator lock. The acoustical isolator is then slid down into the second portion of the acoustical isolator through-hole which has dimensions larger than the stem and smaller than the head, such that the dimensions of the second portion, which is smaller than the first portion, keeps the head from passing through the through-hole. The circumscribed perimeter of the head may have many different shapes including square, round, and oval with square being preferred as it is thought to make the acoustical isolator less prone to inadvertently pulling out of the stud and provides a greater surface area for mating a wall panel to the acoustical isolator. In another embodiment a portion of the acoustical isolator stem engages with the second portion.

Another method for installing the acoustical isolator is to rotatably engage the acoustical isolator into the acoustical isolator through-hole. In such an embodiment, the acoustical isolator through-hole will be sized and shaped such that the acoustical isolator lock may only pass through the acoustical isolator through-hole—with or without deforming—when the acoustical isolator lock is oriented in one specific direction. Once the acoustical isolator lock passes through the acoustical isolator through-hole, the acoustical isolator may then be turned approximately ninety degrees about its central axis. In doing so, the acoustical isolator lock is no longer oriented in such a manner that it is capable of passing back through (or out of) the acoustical isolator through-hole.

FIG. 7 shows a cut-away view of a portion of a first wall panel (300) installed on a stud (100). As shown in FIG. 7, the first wall panel connects to the stud (100) by passing a first fastener (310) through the first wall panel, the first body (212), and into the stud. While FIG. 7 shows the first fastener passing into the stud, embodiments may exist where the first fastener only passes into and/or through the first acoustical isolator (210).

FIG. 8 shows a front view of a wall panel (which may be either a first wall panel (300) or a second wall panel (320)) installed on a stud (100). As shown in FIG. 8, in some embodiments, the assembly may further comprise a track (330) connected to one or more of the studs (100) at the stud first flange and/or at the stud second flange.

Shown in FIG. 9 is a cut-away view of a portion of a first wall panel (300) and a second wall panel (320). As shown in FIG. 9, the second wall panel connects to the stud (100) by passing a second fastener (325) through the second wall panel, the second body (222) of the second acoustical isolator (220), and into the stud. While FIG. 9 shows the second fastener passing into the stud, embodiments may exist where the second fastener only passes into and/or through the second acoustical isolator.

Each second acoustical isolator (220) may have a construction similar or identical to the first acoustical isolator. That is to say that the second acoustical isolator may comprise a second body (222). Extending from a bottom surface of the second body may be one or more second standoff pegs (224). Also extending from the bottom surface of the second body at approximately a central location between a first end and a second end of the second body is a second stem (216). Attached to the second stem is a second lock (228). Preferably, the second lock and at least a portion of the second stem will pass through the second flange acoustical isolator through-hole or partially lanced-hole such that the second lock is adjacent to the inner surface of the second flange while the second body is adjacent to the outer surface of the second flange.

Each of the first acoustical isolator (210) and the second acoustical isolator (220) may be made of a material selected from the group consisting of a cured adhesive, a rubber, a foam tape, a Styrofoam, an amorphous thermoplastic, a silicon, a UV curable coating, a rigid plastic such as nylon, an elastomeric permanently flexible material, and combinations thereof.

Two acoustical isolators were evaluated for the lbs. force to insert the acoustical isolators into the stud and to pull it out. The first acoustical isolator tested was a rigid plastic circular head with a stem of 0.652 inches long from the body to the end of the stem. When inserted, this acoustical isolator was free to move within the through-hole. 13 and 14 lbs. force was required to insert the first acoustical isolator into the stud. 51 and 49 lbs. force was required to remove the acoustical isolator from the stud.

The second acoustical isolator was also a rigid plastic and had a stem length of 0.552 inches from the body to the end of the stem. The acoustical isolator had a rubber gasket/washer on the stem which prevented movement within the stud. The second grommet required 21 and 22 lbs. force to insert the first acoustical isolator into the stud. The acoustical isolator did not come out of the stud, but broke at 55 and 56 lbs. force.

This assembly included the stud, the second acoustic isolator and gasket or washer on the stem between the body and stud. In this case the acoustic isolator was made of a rigid plastic, like nylon and the gasket/washer was rubber.

In addition to improving the acoustical isolation between rooms, it has been found that the invented assembly results in reduced field installation time as acoustical isolators may be preinstalled on the stud prior to hanging the wall panel and shipped to the construction location ready for installation.

What is claimed is:

1. An assembly for acoustical mitigation in a building, said assembly comprising:

a stud (100) having:

a web (110), a first flange (120) extending substantially perpendicular to the web and having at least one first flange acoustical isolator through-hole (124) or partially lanced-hole passing through the first flange from a first flange web side to a first flange side opposite the web; and at least one first acoustical isolator (210); and wherein at least a portion of the first acoustical isolator passes through the first flange acoustical isolator through-hole or partially lanced-hole, with the first acoustical isolator is configured to acoustically isolate the stud and a first wall panel (300) supported by the stud, wherein the at least one first acoustical isolator comprises a first body (212), at least one first standoff peg (214) extending from a bottom surface of the first body, a first stem (216) approximately centrally located and extending from the bottom surface of the first body, and a first lock (218) attached to the first stem, wherein the first lock and a portion of the first stem pass through the first flange acoustical isolator through-hole or partially lanced-hole so that the first lock is on the first flange web side and the first body is on the first flange side opposite the web.

2. An assembly for acoustical mitigation in a building, said assembly comprising:

a stud (100) having:

a web (110), a first flange (120) extending substantially perpendicular to the web and having at least one first flange acoustical isolator through-hole (124) or partially lanced-hole passing through the first flange from a first flange web side to a first flange side opposite the web; and at least one first acoustical isolator (210);

wherein at least a portion of the first acoustical isolator passes through the first flange acoustical isolator through-hole or partially lanced-hole, and the first acoustical isolator is configured to acoustically isolate the stud and a first wall panel (300) supported by the stud, wherein the stud further comprises a second flange (130) extending substantially perpendicular to the web in the same direction as the first flange and having at least one second flange acoustical isolator through-hole (134) or partially lanced-hole passing through the second flange from a second flange web side to a second flange side opposite the web; and the assembly further comprises at least one second acoustical isolator (220);

wherein the second acoustical isolator passes through the second flange acoustical isolator through-hole or partially lanced-hole, and the second acoustical isolator is configured to acoustically isolate the stud and a second wall panel (320) supported by the stud;

wherein the at least one second acoustical isolator comprises a second body (222), at least one second standoff peg (224) extending from a bottom surface of the second body, a second stem (226) approximately centrally located and extending from the bottom surface of the second body, and a second lock (218) attached to the second stem, and wherein the second lock and a portion of the second stem pass through the second flange acoustical isolator through-hole or partially lanced-hole so that the second lock is on the second flange web side and the second body is on the second flange side opposite the web.

* * * * *